United States Patent [19]

McGill

[11] 4,424,860

[45] Jan. 10, 1984

[54] DEFLATE-EQUALIZING VALVE APPARATUS FOR INFLATABLE PACKER FORMATION TESTER

[75] Inventor: Howard L. McGill, Lufkin, Tex.

[73] Assignee: Schlumberger Technology Corporation, New York, N.Y.

[21] Appl. No.: 266,899

[22] Filed: May 26, 1981

[51] Int. Cl.[3] ..... E21B 43/00

[52] U.S. Cl. ..... 166/113; 166/187; 166/188

[58] Field of Search ..... 166/113, 187, 188, 191, 166/264; 277/34, 34.6

[56] References Cited

U.S. PATENT DOCUMENTS

| | | | |
|---|---|---|---|
| 2,816,440 | 12/1957 | Garrison | 73/151 |
| 2,863,511 | 12/1958 | Moosman | 166/224 |
| 3,308,887 | 3/1967 | Nutter | 166/150 |
| 3,439,740 | 4/1969 | Conover | 166/187 |
| 3,876,000 | 4/1975 | Nutter | 166/106 |
| 3,876,003 | 4/1975 | Kisling | 166/187 X |
| 3,926,254 | 12/1975 | Evans et al. | 166/106 |
| 3,941,190 | 3/1976 | Conover | 166/187 |

*Primary Examiner*—Ernest R. Purser
*Assistant Examiner*—Thuy M. Bui

[57] ABSTRACT

In accordance with an illustrative embodiment of the present invention, a pressure equalizing and packer deflating valve apparatus useful in an inflatable packer straddle testing system included telescopically arranged mandrel and housing member defining test and inflation passages, first valve means for communicating the test passage with the well annulus when said members are extended to maintain pressure equalization as the packer elements are inflated, second valve means for communicating the inflation passage with the well annulus when the members are extended to enable packer element deflation; and third valve means that can be shifted in response to pump outlet pressure when said members are extended to a position preventing packer element deflation even though said second valve means is open. As said members are retracted, the third valve means is shifted to a position closing the inflation passage to maintain the inflation pressure therein.

16 Claims, 4 Drawing Figures

DEFLATE-EQUALIZING VALVE APPARATUS FOR INFLATABLE PACKER FORMATION TESTER

FIELD OF THE INVENTION

This invention relates generally to a drill stem testing system using inflatable packers, and particularly to a new and improved valve system for equalizing pressures across and enabling deflation of the packers during the course of a well testing operation.

BACKGROUND OF THE INVENTION

To conduct a drill stem test of a well that has an irregularly enlarged or "washed-out" bore, it is common practice to use packer elements of the type that can be inflated by a downhole pump to isolate and seal off the well interval to be tested. To properly inflate the packer elements it is preferable to provide for the equalization of the pressure of fluids in the space between the packers with the pressure above the upper packer element while inflation fluid under pressure is being supplied to the respective interiors of the packers via an inflation passage that leads from the outlet of the pump. During the test, of course, such pressure equalization must be stopped. At the end of the test the pressures must again be equalized and the packer elements deflated so that the string of tools can be removed from the well or moved to another test elevation therein.

An apparatus for equalizing pressures and for inflating and deflating inflatable packer elements is shown in Conover U.S. Pat. No. 3,439,740 issued Apr. 22, 1969. The apparatus disclosed in this patent, although widely used, is believed to have a number of shortcomings. For example, pressure equalization is accomplished by separate flow paths and valve systems which is an unduly complicated arrangement that can be subject to plugging or other malfunction. Another problem with the Conover apparatus is that in order to deflate the packers at the end of a test, a rather complicated clutch structure that is actuated by setting down weight and rotating the pipe must be operated in order to shift a shuttle valve to a position where a deflate port is opened up to vent the interiors of the packer elements to the well bore.

It is a general object of the present invention to provide a new and improved pressure equalizing and packer deflating valve apparatus useful in straddle testing operations using packer elements that are inflated by a downhole pump that is operated in response to pipe rotation.

Another object of the present invention is to provide a new and improved valve system of the type described that is more compact and simple in construction and operation, and thus more reliable for use in well testing operations.

SUMMARY OF THE INVENTION

These and other objects are attained in accordance with the concepts of the present invention through the provision of valve apparatus comprising a housing having a mandrel assembly axially movable therein between extended and retracted positions. The housing and mandrel assembly define a test passage for conducting formation fluids from an isolated well interval, and an inflation passage that leads from a rotary operated pump to the interior of one or more inflatable packer elements. An equalizing port and a deflate port extend through the wall of the housing. The equalizating port is arranged to be placed in communication with the test passage in the extended position of the mandrel assembly to equalize pressures during initial packer inflation, and at the end of the test when the packer elements are to be deflated. In the contracted position of the mandrel assembly, communication between the equalizing port and the test passage is closed off.

A passage between the housing and the mandrel assembly is arranged to communicate the deflate port with the inflation passage. when the mandrel assembly is moved to its extended position so that the respective interiors of the packer elements can be vented to the well annulus to enable them to deflate. This passage automatically is closed off by a shuttle valve when the inflation pump is started up to enable the packer elements to be inflated with the tool string in tension. Downward movement of the mandrel assembly with respect to the housing causes the passage to be closed off, and also forces the shuttle valve downward to a position where it closes the inflation passage. Thus the present invention provides a simplified and compact valve apparatus that performs the various pressure equalizing and valving functions in connection with inflatable packer drill stem testing operation in a more reliable manner than has been known in the art.

BRIEF DESCRIPTION OF THE DRAWINGS

The present invention has other objects, features and advantages that will become more readily apparent in connection with the following detailed description of a preferred embodiment, taken in conjunction with the appended drawings in which.

DESCRIPTION OF A PREFERRED EMBODIMENT

Figure 1:
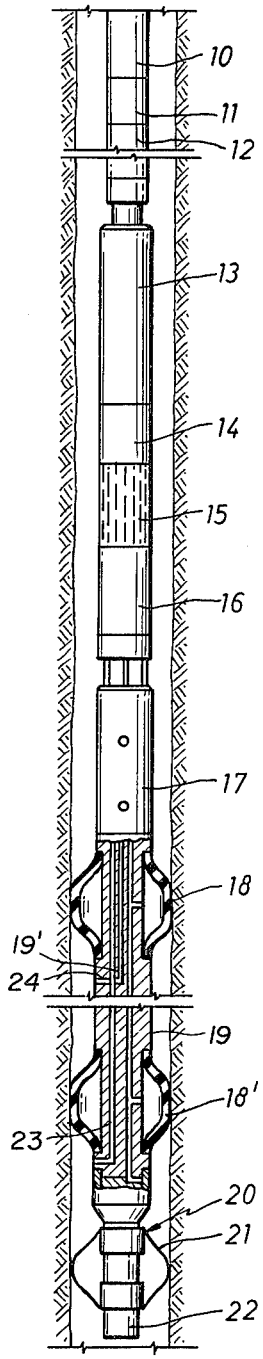
FIG. 1 is a schematic view of a string of drill stem testing tools, utilizing inflatable packers, suspended in a well bore.

Referring initially to FIG. 1 for a schematic illustration of the entire string of drill stem testing tools disposed in a well to be tested, the running-in string 10 of drill pipe or tubing is provided with a reverse circulating valve 11 of any typical design, for example, as shown in U.S. Pat. No. 2,863,511. A suitable length of pipe 12 is connected between the reversing valve 11 and a multi-flow evaluator or test valve assembly 13 that functions to alternately flow and shut-in the formation interval to be tested. A preferred form of test valve is shown in Nutter U.S. Pat. No. 3,308,887, assigned to the assignee of this invention. The lower end of the test valve 13 is connected to a recorder carrier 14 that houses a pressure recorder of the type shown in the assignee's U.S. Pat. No. 2,816,440, the recorder functioning to make a permanent record of fluid pressure versus elapsed time as the test proceeds. The recorder carrier 14 is connected to the upper end of a screen sub 15 through which well fluids are taken in during operation of a packer inflation pump assembly 16 connected to the lower end thereof. The pump assembly 16 is disclosed in Upchurch application Ser. No. 103,660, now U.S. Pat. No. 4,320,800, also assigned to the assignee of this invention. The disclosure of the said Upchurch application is incorporated herein by reference.

Other rotary pumps such as the device shown in the above-mentioned Conover patent, or the Evans et al U.S. Pat. No. 3,926,254, could also be used.

The lower end on the pump assembly 16 is connected to a pressure equalizing and packer deflating valve apparatus 17 that is constructed in accordance with the present invention. The valve 17 is coupled to the upper end of a straddle-type inflatable packer system that includes an upper packer element 18 and a lower packer element 18' that are connected together by an elongated spacer sub 19. The packer elements 18 and 18' each include an internally reinforced elastomeric sleeve that normally is retracted but which can be expanded outwardly by applied internal pressure into sealing contact with the surrounding well wall. The length of the spacer pipe 19 is selected such that during a test the upper packer 18 is above the upper end of the formation interval of interest, and the lower packer 18' is below the lower end of the interval. Of course when the elements 18 and 18' are expanded, the well interval therebetween is isolated or sealed off from the rest of the well bore so that a fluid recovery from the interval can be conducted via a test passage 19' from test ports 24 through the tools described above and into the pipe string 10. A straddle bypass passage 23 also is provided.

The lower end of the packer system is connected to the upper end of a deflate-drag spring tool 20 of the type disclosed in the aforementioned Upchurch application. The drag springs 21 associated with the tool 20 are bowed outwardly and frictionally engage the walls of the well bore to enable the relative rotation that is necessary to operate the pump assembly 16. Another recorder carrier 22 can be connected to the lower end of the drag spring tool 20 and houses pressure recorders that are arranged to measure directly the formation fluid pressure in the isolated interval. A comparison of the data recorded by this instrument with that recorded by the upper instrument 14 can indicate whether or not test passages and ports have been plugged or blocked by debris or the like during the test.

Figure 2A:
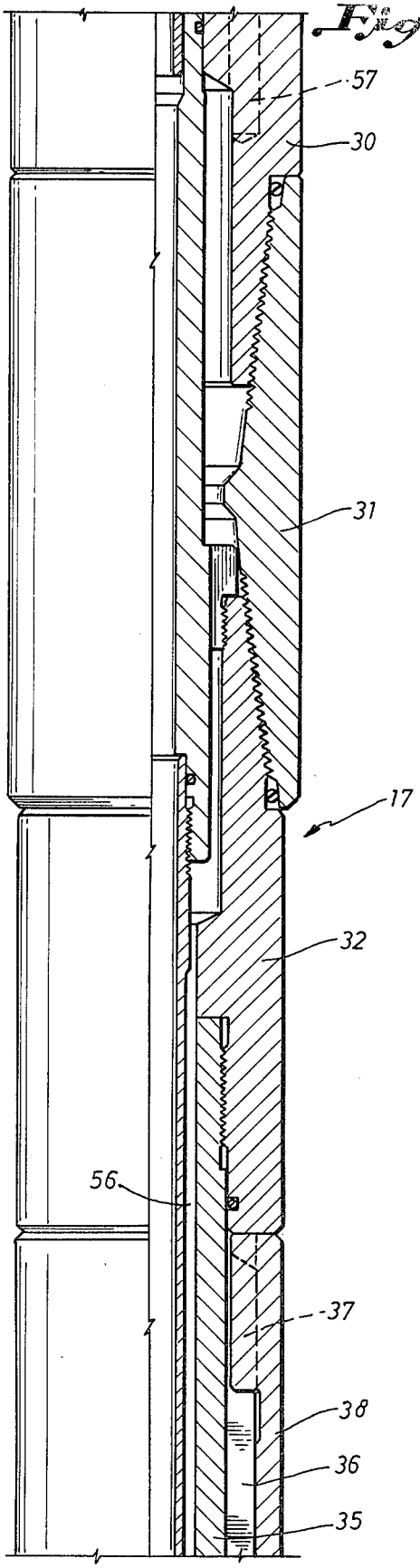
FIGS. 2A–2C are cross-sectional views, with portions in side elevation, of a deflate-equalizing valve that is constructed in accordance with the present invention.
Figure 2B:
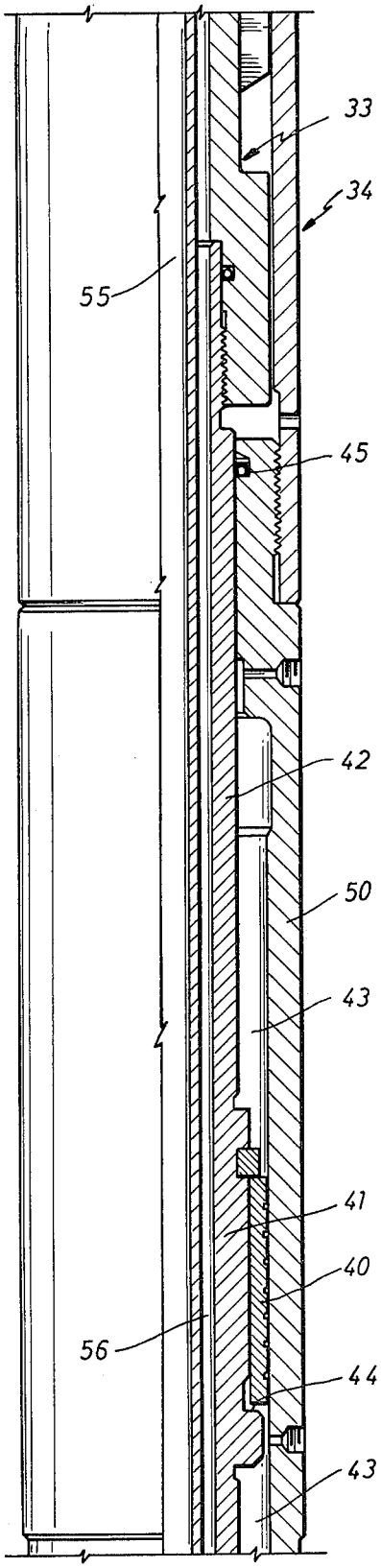
Figure 2C:
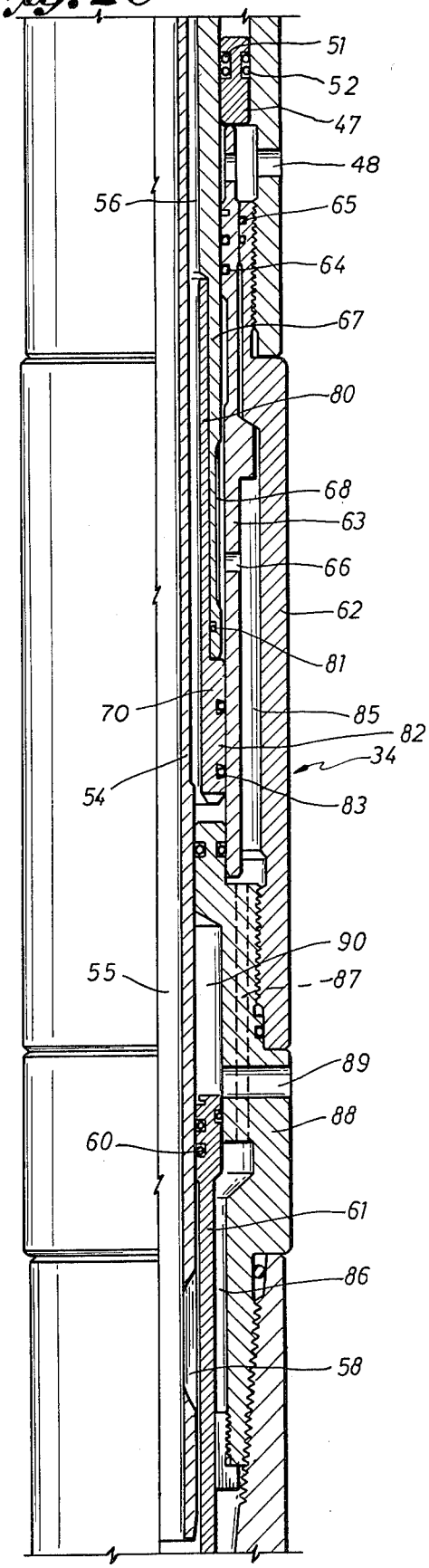

Turning now to FIGS. 2A–2C for an illustration of structural details of the delfate-equalizing valve 17, the lower end of the rotary pump housing 30 is connected by a collar 31 to the upper sub 32 of a mandrel assembly indicated generally at 33 that is telescopically disposed within a generally tubular housing 34. The mandrel assembly 33 includes a spline section 35 that has outwardly directed splines 36 which mesh with inwardly directed splines 37 on the upper end section 38 of the housing 34 to prevent relative rotation while enabling limited longitudinal relative movement. A hydraulic delay system includes a metering piston 40 that is movably mounted on a thickened portion 41 of an intermediate section 42 of the mandrel assembly, with the piston being sized to provide for a restricted leakage of hydraulic fluid contained in an annular chamber 43 from above the piston to below same during upward movement. However, the piston 40 can move away from an annular valve seat 44 during downward movement of the mandrel within the housing so that hydraulic fluid can pass freely through external grooves (not shown) in the mandrel section 41 behind the metering piston. The chamber 43 is closed at its upper end by a seal ring 45 and at its lower end by a floating balance piston 47 whose lower face is subjected to the pressure of fluids in the well annulus by one or more ports 48 extending through the wall of the cylinder section 50 of the housing 34. The balance piston 47, which carries inner and outer seal rings 51, 52, functions to transmit the pressure of well fluids to the hydraulic fluid below the piston 40 so that pressure in this region of the chamber is never less than the hydrostatic head pressure in the well bore outside the housing 34.

An elongated flow tube 54 that is fixedly mounted within the mandrel assembly 33 has a central bore 55 that provides an upwardly extending passage for formation fluids that are recovered during the test. The outer periphery of the tube 54 is spaced inwardly of the inner wall surface of the mandrel assembly 33 to provide an inflation passage 56 that leads from the outlet ports 57 of the rotary pump 16 to the respective interiors of the packer assemblies 18 and 18'. The lower end portion of the flow tube 54 has one or more relief passage slots 58 that are disposed below the seals 60 of a sleeve 61 that is fixed within the housing 34 when the mandrel assembly 33 is telescoped downwardly to its lower position therein, and which are disposed above the seals 60 when the mandrel assembly is extended with respect to the housing.

A valve section 62 of the housing 34 that is connected to the lower end of the cylinder section 50 has a seat sleeve 63 mounted therein. The sleeve 63 is sealed with respect to the mandrel section 42 and the section 50 by O-rings 64 and 65, and one or more inflation ports 66 extend laterally through the wall thereof intermediate its ends. The lower end portion 67 of the mandrel 42 constitutes a sleeve valve having circumferentially spaced, longitudinally extending flow grooves 68 located adjacent its lower end. A second valve sleeve 70 is mounted for independent vertical movement with respect to the seat sleeve 63 and mandrel portion 67, and has a reduced diameter upper section 80 that is sealed with respect to the portion 67 by an O-ring 81, and an enlarged diameter lower section 82 that is sealed with respect to the seat sleeve by O-ring 83. If desired, a small diameter port (not shown) can be provided near the lower end of the seat sleeve 63 for purposes to be described hereinafter.

The annular region 85 outside the seat sleeve 63 is communicated with a lower continuation 86 of the packer inflation passage by several vertical ports 87 indicated in phantom lines in FIG. 2C. Radially offset from the ports 87 and formed in the same sub 88 is an equalizing port 89 that communicates with an interior space 90 within the housing.

OPERATION

In operation, the string of testing tools is assembled end-to-end generally as shown in the drawings and run into the well bore. As the equipment is being lowered, the drag springs 21 frictionally engage the walls of the bore hole to afford a degree of restraint to vertical as well as rotational movement. The pipe string 10 is either empty of fluids, or may contain a column of water to act as a cushion as will be apparent to those skilled in the art. In any event, the interior of the pipe string 10 provides a low pressure region which can be communicated with an isolated interval of the well to induce formation fluids to flow from the formation into the pipe string if they are capable of so doing.

When the tool string is run to a proper depth such that the upper packer 18 is above the top of the interval to be tested and the lower packer 18' is below it, the interval is isolated by inflating the elements 18 and 18' into sealing contact with the well wall through operation of the pump assembly 16. This is accomplished by rotating the pipe string 10 to the right to cause the pump to intake well fluids from the annulus via the screen 15 and to exhaust same under pressure to the inflation passage 56. At this time, the mandrel assembly 33 will be in its extended position with respect to the housing 34 where the pressure relief slots 58 are located above the seals 60 so that the test passage 55 is in communication with the well annulus above the upper packer element via the space 90 and the lower port 89. Fluid pressure in the inflation passage 56 will act upwardly on the lower section 82 of the valve sleeve to shift it upwardly to a position where the seals 83 are above the port 66 to enable inflation fluids to pass downwardly through the annular region 85, the vertical ports 87 and the continuing passage 86 to the respective interiors of the packing elements 18 and 18' to cause them to inflate and thereby expand into sealing engagement with the surrounding well wall. At a predetermined maximum inflation pressure, the pump 16 automatically will cease pumping as described in the above-mentioned Upchurch patent application, whereupon rotation of the pipe string 10 is stopped.

During inflation, any well fluids that are displaced through enlargement of the packer elements can pass via the test ports 24, the test passage 19', 55, the slots 58 and the port 89 to the well annulus above the upper packer.

To initiate the test, the weight of the pipe string 10 is slacked off on the packers 18 and 18' to close the deflate-equalizing valve 17 and open the tester valve 13. As the mandrel assembly 33 and the flow tube 54 telescope downwardly within the housing 34, the flow slots 58 are positioned below the seals 60 to close off annulus communication, and the valve head 82 is pushed down below the inflation ports 66 to close the inflation passage 56, 86. The outer surface of the mandrel section 67 above the flow slots 68 is engaged by the seals 64 to prevent communication between the inflation passage and the well annulus via the deflate ports 98.

The pipe string 10 can be repeatedly lifted and lowered to open and close the tester valve 13 without opening the deflate-equalizing valve 17 because the hydraulic delay piston 40 retards upward movement. When it is desired to deflate the packer elements 18 and 18' and terminate the test, a strain is placed in the pipe string 10, and tension is maintained for a time sufficient to cause the delay piston 40 to reach the upper end of the chamber 43. As the mandrel assembly 33 moves upwardly relative to the housing 34, the flow slots will span the seals 64 to communicate the inflation passage 85 with the well annulus via the deflate ports 98, and the equalizing slots 58 in the flow tube 54 are moved above the seals 60 to communicate the well interval being tested with the well annulus above the upper packer element 18 via the port 89. In this manner, all of the various pressures are equalized with one another, and the packing elements 18 and 18' can inherently deflate and retract to their original relaxed dimensions. Then the tool string can be withdrawn from the well, or moved to another level in the well for additional tests.

It will be recognized that a new and improved apparatus has been provided for equalizing pressures and for enabling inflation and deflation of packer elements during the course of a drill stem test. As previously mentioned, a small port near the lower end of the seat sleeve 63 may be provided, and has the advantage of enabling the rotary pump assembly to be operated with pipe weight slacked-off on the tools. Where the said small port is utilized, inflation fluid flow therethrough during initial operation of the pump with the mandrel assembly 33 extended provides a choking action and generation of a back pressure which will cause the valve head 82 to shift upward and close off communication between the inflation passage and the deflate ports 98, provided that the valve head was not already so positioned.

Since certain changes or modifications may be made by those skilled in the art without departing from the inventive concepts disclosed herein, it is the aim of the appended claims to cover all such changes and modifications falling within the true spirit and scope of the present invention.

What is claimed is:

1. Valve apparatus adapted for use in connection with a downhole pump that supplies well fluids under pressure to inflatable packers to cause the same to expand and thereby isolate a well interval, comprising: telescopically arranged mandrel and housing assemblies movable between extended and retracted relative positions, said assemblies defining axially extending test and inflation passages; first valve means for communicating said test passage with the well annulus above said inflatable packers when said assemblies are in said extended relative position to maintain pressure equalization during packer element inflation; second valve means for communicating said inflation passage with the well annulus above said inflatable packers when said assemblies are in said extended relative position to enable packer element deflation; and third valve means responsive to the outlet pressure of said pump for preventing packer element deflation when said pump is being operated with said assemblies in said extended relative position even though said second valve means is open.

2. The apparatus of claim 1 further including means for closing said third valve means in response to movement of said assemblies to said retracted relative position.

3. The apparatus of claim 2 further including means for preventing rotation of said mandrel assembly relative to said housing assembly.

4. The apparatus of claim 3 further including means for delaying or retarding relative movement of said assemblies from said retracted to said extended position to enable operation of associated test valve apparatus by vertical pipe motion without deflating the packers or equalizing pressures.

5. Valve apparatus adapted for use in a well testing operation where inflatable packers that are expanded by a downhole pump are employed to isolate an interval of a well bore, comprising: a housing having a mandrel assembly movable therein between extended and retracted positions, said mandrel assembly and housing defining a packer inflation passage and a test passage; an equalizing port and a deflate port extending through the wall of said housing; first passage means for communicating said equalizing port with said test passage; first valve means for closing said first passage means when said mandrel assembly is retracted and for opening said first passage means when said mandrel assembly is extended; second passage means for communicating said deflate port with said inflation passage; second valve means for closing said second passage means when said mandrel assembly is retracted and for opening said second passage means when said mandrel assembly is extended; and third valve means operable in response to the output pressure of said pump for closing said second passage means when said mandrel assembly is extended.

6. The apparatus of claim 5 wherein said mandrel assembly included inner and outer tubular members, the bore of said inner member providing said test passage, said members being laterally spaced and arranged such that the annular area therebetween provides an upper portion of said inflation passage, said first passage means being formed interiorly of said housing adjacent said inner tubular member and said second passage means being formed interiorly of said housing adjacent said outer tubular member.

7. The apparatus of claim 6 wherein said first valve means includes seal means on said housing slidably engaging an outer wall surface of said inner member, and port means extending through the wall of said inner member that is arranged to be positioned above said seal means when said mandrel assembly is extended and below said seal means when said mandrel assembly is retracted.

8. The apparatus of claim 6 wherein said second valve means includes seal means on said housing slidably engaging an upper outer wall surface of said outer member, and longitudinally extending slot means formed in a lower outer wall surface of said outer member, said slot means being positioned across said seal means in the extended position of said mandrel assembly and below said seal means in the retracted position of said mandrel assembly.

9. The apparatus of claim 6 wherein said housing includes a sleeve member mounted interiorly thereof and having an outer wall surface laterally spaced with respect to an adjacent inner wall surface to provide a lower portion of said inflation passage, said sleeve member having an inflation port extending through the wall thereof.

10. The apparatus of claim 9 wherein said third valve means comprises a sleeve piston having an lesser diameter upper section and a greater diameter lower section, said upper section being sealed with respect to said outer member and said lower section being sealed with respect to said sleeve member, said sleeve piston being movable relatively along said sleeve member between a lower position where said lower section is above said inflation port to enable the same to communicate said upper and lower inflation passages and a lower position where said lower section is below said inflation port to block communication between said upper and lower inflation passages.

11. The apparatus of claim 10 wherein the difference in the outer diameters of said upper and lower sections of said sleeve piston defines a transverse cross-sectional area that is subject to the pressure of inflation fluids in said upper portion of said inflation passage to enable such pressure to shift said sleeve piston from its lower to its upper position relative to said sleeve member when said mandrel assembly is in extended position and said pump is being operated.

12. The apparatus of claim 10 further including coengagable shoulder surfaces on said outer member and said sleeve piston for forcing said sleeve piston to its lower position with respect to said sleeve member when said mandrel assembly is moved to its retracted position.

13. The apparatus of claim 12 further including an additional port extending through the wall of said sleeve member at a location below the lower position of said sleeve piston, said additional port having a substantially smaller area than the area of said inflation port to afford a restriction to the flow of inflation fluids being supplied by said pump to correspondingly provide a back-pressure in said upper inflation passage to cause movement of said sleeve piston to its upper position when said mandrel assembly is extended.

14. The apparatus of claim 5 further including spline means for corotatively coupling said mandrel assembly and said housing to one another.

15. The apparatus of claim 5 further including means for delaying upward movement of said mandrel assembly relative to said housing to facilitate the operation of associated test valve apparatus by vertical manipulation of the pipe string without opening said first and said second valve means.

16. Apparatus for use in testing a well interval, comprising: inflatable packer means for isolating the well interval; test valve means for controlling communication between the well interval and the bore of a pipe string upon which the apparatus is suspended; pump means responsive to rotation of the pipe string for inflating said packer means; and valve means for equalizing pressure in the isolated well interval with the pressure in the well annulus above said inflatable packer elements during initial inflation thereof as well as at the end of a test, and for causing deflation of said packer elements at the end of a test including telescopically arranged mandrel and housing assemblies movable between extended and retracted positions and defining a test passage and an inflation passage, equalizing port and passage means in said housing assembly, deflate port and passage means in said housing assembly, first valve means for communicating said equalizing port and passage means with said test passage when said assemblies are extended, second valve means for communicating said deflate port and passage means with said inflation passage when said assemblies are extended, and third valve means responsive to to movement of said assemblies to contracted positions for closing said inflation passage and to the outlet pressure of said pump means when said assemblies are extended to open said inflation passage while preventing communication between said deflate port and passage means and said inflation passage.

* * * * *